US005614282A

United States Patent [19]

Bono, Jr. et al.

[11] Patent Number: 5,614,282

[45] Date of Patent: Mar. 25, 1997

[54] FABRIC STRUCTURAL MEMBERS

[75] Inventors: James J. Bono, Jr.; Gary L. Flasher, both of Spring City, Pa.

[73] Assignee: Davlyn Manufacturing Co., Inc., Spring City, Pa.

[21] Appl. No.: 497,297

[22] Filed: Jun. 30, 1995

[51] Int. Cl.[6] ..... B32B 3/12

[52] U.S. Cl. ..... 428/116; 442/203; 442/304

[58] Field of Search ..... 428/116, 123, 428/284, 257, 253

[56] References Cited

U.S. PATENT DOCUMENTS

| | | | |
|---|---|---|---|
| 3,578,764 | 5/1971 | Nunnally et al. | 87/6 |
| 4,335,589 | 6/1982 | Flasher | 66/202 |
| 4,754,685 | 7/1988 | Kite et al. | 87/9 |
| 4,759,976 | 7/1988 | Dutt | 428/257 |
| 4,836,080 | 6/1989 | Kite, III et al. | 87/9 |
| 4,862,922 | 9/1989 | Kite III | 138/119 |
| 4,870,887 | 10/1989 | Tresslar et al. | 87/9 |
| 4,931,326 | 6/1990 | Weil | 428/35.8 |
| 5,066,028 | 11/1991 | Weil | 277/181 |
| 5,107,623 | 4/1992 | Weil | 49/485 |
| 5,151,316 | 9/1992 | Durhin et al. | 428/257 |
| 5,416,961 | 5/1995 | Vinay | 428/296 |
| 5,480,697 | 1/1996 | Bottger et al. | 428/257 |

*Primary Examiner*—James J. Bell

*Attorney, Agent, or Firm*—Pantich Schwarze Jacobs & Nadel, P.C.

[57] ABSTRACT

A man-made, flexible, knitted member is formed from at least one continuous strand of a conventional knittable flexible material knitted in a tubular or circular form with at least two sets of interlocked stitches extending longitudinally along opposite sides of the tubular form with opposite ends of the stitches of each row of each set being connected by unstitched lengths of the strand material to the ends of stitches of adjoining rows of the remaining set. A planar member is made by flattening the original tubular form longitudinally through both sets of stitches. The resulting structure is thicker at both ends due to the overlap of the strand material in the stitches and thinner between the end where the unstitched length of the strand material is provided. When flattened, the structure has a ladder-like appearance with interlocked stitched portions forming side rails of the structure and unstitched lengths of the strand forming a rung portion of this structure interconnecting the side rail portions. The unstitched strands connecting the two side rail portions are distinct having a saw-toothed pattern with curved or scalloped individual rungs, at least in the knitted version of the invention.

7 Claims, 1 Drawing Sheet

FABRIC STRUCTURAL MEMBERS

FIELD OF THE INVENTION

This invention relates generally to fabric structural members.

BACKGROUND OF THE INVENTION

Fabric structural members, particularly tubular knitted and braided structural members, have been long and widely known and are disclosed, for example, in U.S. Pat. Nos. 4,986,033 and 4,979,280. The former discloses knit wire and braided fiberglass tubular members as well as a flat braided fiberglass member. The latter discloses the use of knit wire tubular members as cylindrical and, when flattened, planar structural members.

Flattened tubular knit wire members have significant tensile strength in longitudinal and transverse directions. By proper selection of appropriate wire material, thickness, hardness and numbers of strand ends, such members can be provided with significant longitudinal and transverse resilience. However, such flattened members have a substantially uniform thickness which limits their usefulness in some product constructions.

SUMMARY OF THE INVENTION

In one aspect, the invention is a machine-made, flexible, continuous, substantially planar fabric member having a ladder-like structure comprising a pair of continuous, longitudinally extending, side rail portions formed of interlocked portions of strand material, the side rail portions being spaced apart from one another and connected to one another by an intermediate rung portion, the rung portion including a plurality of individual unstitched strand material rungs extending generally diagonally between the side rail portions.

In another aspect, the invention is a machine-made, flexible, knitted member comprising at least one continuous, flexible material strand knitted in a tubular form with at least two sets of interlocked stitches extending longitudinally along opposite sides of the tubular form, each set being formed by consecutive interlocked rows of two or more stitches each, opposite ends of the stitches of each row of one set being connected by unstitched lengths of the strand to ends of adjoining rows of stitches in the remaining set of stitches.

In yet another aspect, the invention is a machine-made, flexible, knitted member comprising a continuous, flexible strand in a continuous circular knit in which the flexible strand forms sets of at least two interlocked stitches on each of two sides of the member and unstitched lengths of the strand connect the two sets of interlocked stitches of the strand on each side of the member, the member being relatively flattened at and between the two sets of stitches such that the unstitched lengths of the strand form a saw-tooth pattern extending along the member connecting the two flattened sets of stitches.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentality shown. In the drawings which are all diagrammatic.

DETAILED DESCRIPTION OF THE INVENTION

Figure 1:
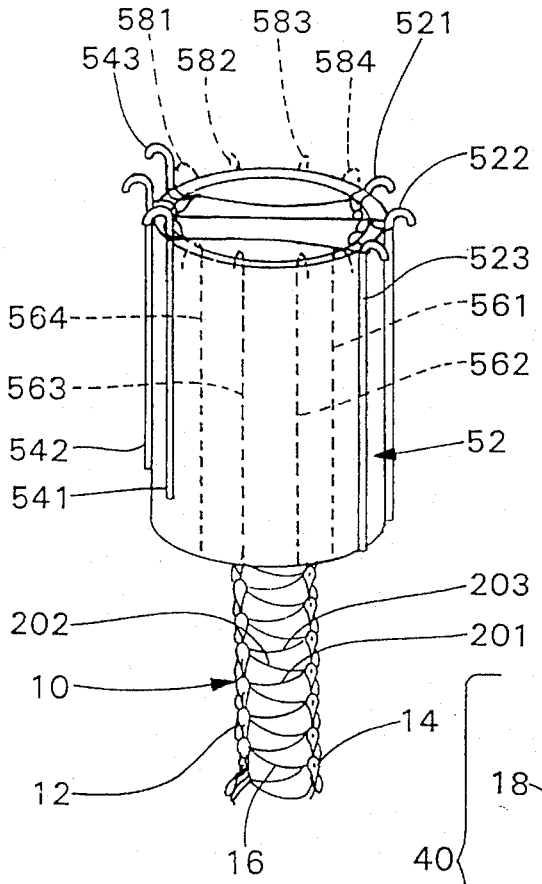
FIG. 1 is a perspective view of a machine-made structural member of the present invention having a ladder-like structure, and of the head of a conventional circular knitting machine showing the location of the needles for making the member.

Referring to the drawings, in which like numerals are used to indicate like elements throughout the several figures, there is shown a portion of a preferred embodiment, machine-made, flexible, continuous, substantially planar fabric structural member of the present invention indicated generally at 10. Referring first to FIG. 1, the member 10 has a ladder-like structure which includes a pair of continuous, longitudinally extending, side rail portions indicated generally at 12 and 14, respectively, spaced apart from one another and, at the same time, connected to one another by an intermediate rung portion indicated generally at 16. The rung portion includes only a plurality of individual "rungs" indicated at 201, 202, 203, (etc.). The individual rungs 201, 202, 203, (etc.) each extend generally diagonally between the woven side rail portions 12 and 14, and, in the preferred embodiment shown, are sufficiently curved and diagonal to define a saw-toothed pattern of curved or scalloped individual rungs.

Figure 2:
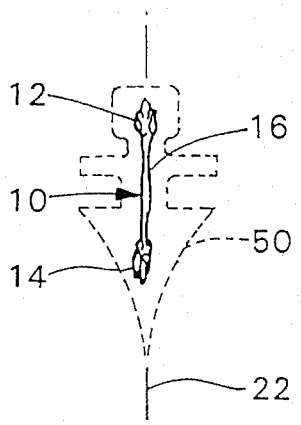
FIG. 2 is a cross sectional view of FIG. 1 taken along the lines 2—2.

FIG. 2 is a diagrammatic cross section of FIG. 1 generally perpendicular to the plane of the member 10. As is indicated diagrammatically, the side rail portions 12 and 14 are substantially thicker in a direction perpendicular to the plane of the member 10, which is further indicated diagrammatically in FIG. 2 by axis 22, than is the rung portion 16. The thicknesses of the side rail portions are generally at least twice the thickness of the rung portion 16 in the direction generally perpendicular to the plane of member 10, where the plane is indicated in FIG. 2 by axis 22.

Figure 3:
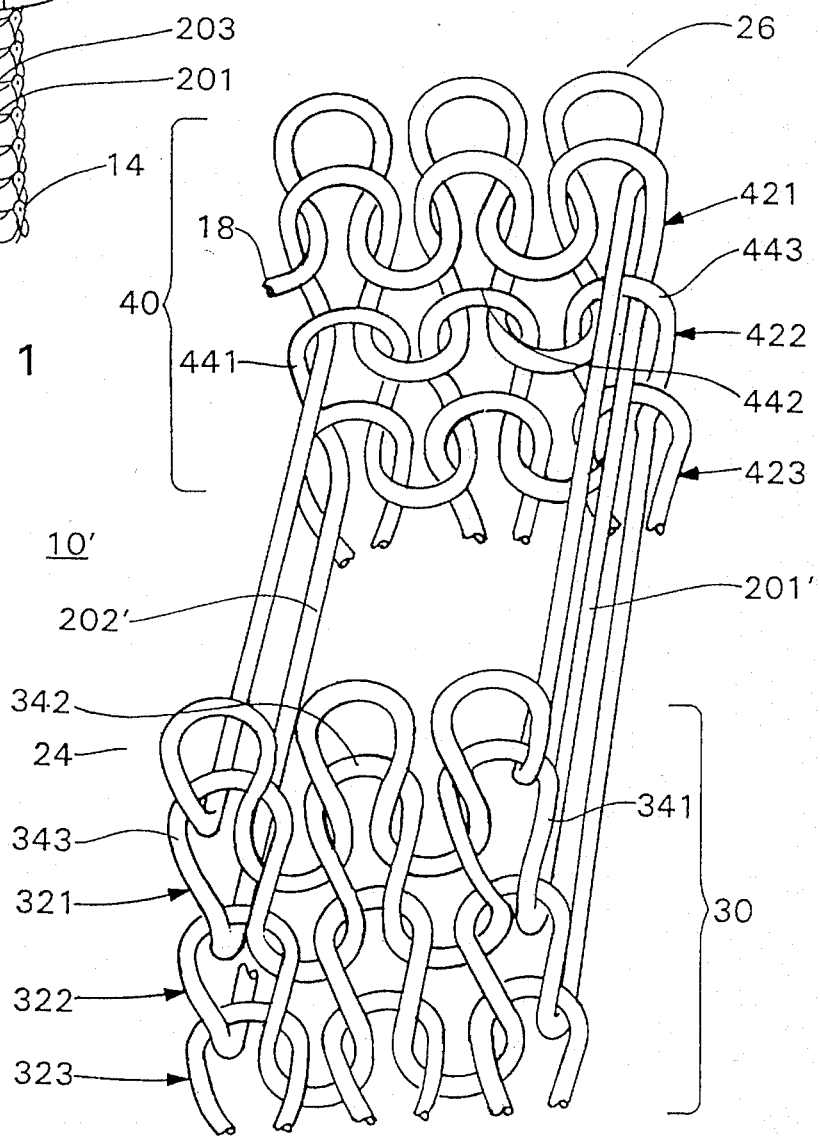
FIG. 3 is a detailed perspective view showing the original tubular form of the member before compression into a planar form.

FIG. 3 depicts diagrammatically the original tubular nature of member 10 of FIGS. 1 and 2. The original tubular form of the member 10 is indicated generally at 10' in FIG. 3. The member 10/10' is formed by at least one continuous strand 18 of a flexible fabric material, preferably a metal wire. In the depicted preferred embodiment, the wire strand material 18 is preferably knitted into the tubular form 10' with at least two sets of interlocked stitches indicated generally at 30 and 40, respectively, extending longitudinally along opposite sides 24, 26, respectively, of the tubular form 10'. Set 30 is formed by consecutive interlocked rows, 321, 322, 323 (etc.) of two or more and preferably at least three interlocked stitches 341, 342, 343. The remaining set of stitches 40 is similarly formed by consecutive interlocked rows 421, 422, 423, (etc.) where each row is formed by two or more and preferably at least three interlocked stitches 441, 442, 443.

The opposite ends of the stitches of each row of each set are connected with adjoining rows of stitches of the remaining set by unstitched lengths of the strand 18 defining individual rungs of the intermediate rung portion 16. For example, one end of row 321 on the near side of form 10', in particular one end of stitch 341, is connected with stitches of row 422 by unstitched or unlocked length 201' of the strand 18 while the opposite end of the row 321, in particular the end of stitch 343, is connected by unstitched or unlocked length 202' of strand 18 with the first stitch 441 of row 421 of the second set of stitches 40 on the opposite side of the tubular form 10'. Row 421 adjoins row 422 in the remaining set of stitches 40. The tubular form 10' is preferably folded through each of the opposing sets of stitches 30 and 40, approximately in the middle of those sets of stitches, to form the member 10 of FIGS. 1 and 2 with each folded set of stitches 30 and 40 forming one of the side rail portions 12 and 14 and with unstitched lengths 201', 202', etc., forming the individual rungs 201, 202, etc., of the member 10. The side rail portions 12 and 14 of member 10 are thus formed from interlocked portions of the strand material 18 while rungs 201, 202, etc., are formed by individual, unstitched portions of the strand material 18. The individual stitches 341, 342, 343, 441, 442, 443 look like jersey stitches on the outer side of the tubular member 10 and like purl stitches on the inner side of the member 10.

It will be appreciated by those skilled in the art that the member 10 can be formed from any strand material suitable for the fabricating methods selected. For example, for knitting, the flexible strand material may be a natural or manmade yarn of multiple individual filaments or a manmade monofilament like polymer plastic or metal wire. As an example, members 10 made of single strand, full hard, four mil. diameter (0.004 in.) 304 stainless steel wire can be used as longitudinally extending reinforcement member of a flexible wiper blade, like blade 50 indicated in cross section in phantom in FIG. 2. The member 10 acts as a resilient reinforcement member improving tensile strength in all directions and bending resilience in at least the longer of the two dimensions of the member 10 depicted in FIG. 2. The polymer plastic or rubber material forming the bulk of the blade being molded or extended around the member 10, with the material flowing into the spaces of the member within and between the stitches and between the rungs, providing excellent mechanical engagement between member 10 and the outer material. As is further depicted in FIG. 2, the thinner, rung portion 16 of member 10 can be located in the thinnest area of the blade 50 or other device being reinforced by the member 10, while the side rail portions 12 and 14 can be located in the thicker areas of the blade 50.

Members like the member 10 can be fabricated from as little as a single strand of 2 mil. thick wire. In addition, thicknesses greater than 4 mils. can also be used up to any thickness which might be conventionally knitted for the material and hardness selected. For example wire up to 12 mil. in diameter could be knitted into member 10. On a conventional four inch diameter knitting head, 110 lb. per thousand fiberglass yarn, about one-eighth inch in diameter, can be knit into member 10.

Although the preferred embodiment is shown utilizes only a single strand 18, two or more continuous strands (or "ends") could be interlocked and, in particular knitted, in parallel. Moreover, the strands need not be identical or even of the same material, but could be dissimilar such as an organic yarn and a wire strand or a wire strand and a glass fiber yarn, etc., depending upon the ultimate desired end use.

The preferred embodiment member 10 could be made on a conventional wire or string knitter made by the Lamb Knitting Co. of Chicopee, Mass. For example, as is also shown in FIG. 1, the device 10 might be made with a 14 needle head 52 (indicated diagrammatically) of such machine about one-inch in diameter by the provision of two sets of needles 521, 522, 523, and 541, 542, 543 on opposite sides of the head 52. The remaining needle locations 561, 562, 563, 564 and 581, 582, 583, 584 (in phantom), are left empty and the strand 18 forms the individual rungs 201, 202, 203, etc. while spanning the empty needle locations 561–564 or 581–584.

While knitting is preferred, other methods of making fabric having interlocked strand portions can be used, namely braiding and weaving, to provide tubular members which have substantially thicker side rail portions of interlocked strand material and the thinner, intermediate rung portions of unstitched, unlocked strand material. Structural members like those of the present invention can be braided or woven in a tubular form and flattened or braided or woven directly in a flattened form.

In addition to being used as a reinforcement, the member 10 can be used as a structural member itself or can be embedded in a hard setting resin or other hard setting material to create rigid, composite reinforced load bearing beam type members.

While preferred embodiments have been disclosed and certain modifications thereto suggested, other modifications will occur to those of ordinary skill in the art. The invention is, therefore, not limited to the particular embodiments depicted or described but rather includes all embodiments encompassed by the appended claims.

We claim:

1. A machine-made, flexible, continuous, substantially planar fabric structural member having a ladder-like structure comprising a pair of continuous, longitudinally extending, side rail portions formed of interlocked portions of strand material, the side rail portions being spaced apart from one another and connected to one another by an intermediate rung portion, the rung portion including a plurality of individual unstitched strand material rungs extending generally diagonally between the woven side rail portions, the member comprising a single continuous, flexible material strand knitted in a tubular form with at least two sets of interlocked stitches extending longitudinally along opposite sides of the tubular form defining the side rail portions, each set being formed by consecutive interlocked rows of two or more stitches, opposite ends of the stitches of each row of one set being connected with stitches of the remaining set of stitches by unstitched lengths of the strand defining individual rungs of the intermediate rung position.

2. The member of claim 1 wherein each of the side rail portions has a thickness generally perpendicular to the plane of the member at least twice a thickness of the rung portion generally perpendicular to the plane of the member.

3. The member of claim 1 wherein the unstitched lengths of the strand join the opposite ends of each row of the one set to ends of adjoining rows of stitches in the remaining set of stitches.

4. The member of claim 1 wherein each row is formed by at least three interlocked stitches.

5. The member of claim 1 wherein the strand is an at least partially hardened metal wire.

6. A machine-made, flexible, knitted member comprising at least one continuous, flexible material strand knitted in a tubular form with at least two sets of interlocked stitches extending longitudinally along opposite sides of the tubular form, each set being formed by consecutive interlocked rows of two or more stitches each, opposite ends of the stitches of each row of one set being connected by unstitched lengths of the strand to ends of adjoining rows of stitches in the remaining set of stitches.

7. A machine -made, flexible, knitted member comprising a continuous, flexible material strand in a continuous circular knit in which the strand forms sets of at least two interlocked stitches on each of two sides of the member and unstitched lengths of the strand connect the two sets of interlocked stitches of the strand on each side of the member, the member being relatively flattened at and between the two sets of stitches such that the unstitched lengths of the strand form a saw-tooth pattern extending along the member connecting the two flattened sets of stitches.

* * * * *